US012116185B2

(12) United States Patent
Hengami

(10) Patent No.: US 12,116,185 B2
(45) **Date of Patent: *Oct. 15, 2024**

(54) DUAL CELL, EFFICIENT BOX WITH TOP SLIDE OPENINGS AND VIEW WINDOWS

(71) Applicant: David Todjar Hengami, Torrance, CA (US)

(72) Inventor: David Todjar Hengami, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/338,464

(22) Filed: Jun. 21, 2023

(65) Prior Publication Data

US 2023/0331433 A1 Oct. 19, 2023

Related U.S. Application Data

(63) Continuation of application No. 17/411,397, filed on Aug. 25, 2021, now Pat. No. 11,691,783, and a (Continued)

(51) Int. Cl.
*B65D 5/48* (2006.01)
*B65D 5/02* (2006.01)
(Continued)

(52) U.S. Cl.
CPC ..... *B65D 5/723* (2013.01); *B65D 5/0227* (2013.01); *B65D 5/0254* (2013.01); *B65D 5/4204* (2013.01); *B65D 5/48014* (2013.01)

(58) Field of Classification Search
CPC ... B65D 5/48018; B65D 5/723; B65D 5/4204
(Continued)

(56) References Cited

U.S. PATENT DOCUMENTS 1,543,953 A 6/1925 Rothschild
1,951,274 A 3/1934 Denman
(Continued)

FOREIGN PATENT DOCUMENTS

CN 204399639 6/2015
DE 10044018 3/2002
(Continued)

OTHER PUBLICATIONS

PCT/US2011/021014. International Search Report and Written Opinion dated Jan. 12, 2011. 9 pages.
(Continued)

*Primary Examiner* — Nathan J Newhouse
*Assistant Examiner* — Phillip D Schmidt
(74) *Attorney, Agent, or Firm* — Concourse Law Group; Katherine B. Sales, Esq.

(57) ABSTRACT

A dual compartment box formed from a blank having a front panel, a first minor side panel, a rear panel, a second minor side panel, a second compartment front panel, a compartment minor side panel, and an inner tab. There is a first slide and a second slide extending from a first compartment top flap and a second compartment top flap, respectively, and they are movable between an upright semi-open position permitting product to dispense through the apertures and a downward closed position blocking the apertures. When the blank is folded, two compartments are formed, and an outer tab top flap and a minor side top flap overlap each other and the projecting portions of both the outer tab top flap and the minor side top flap form a center stop member that interacts with the slides to prevent them from becoming disengaged with the package.

19 Claims, 4 Drawing Sheets

Related U.S. Application Data continuation of application No. 16/192,740, filed on Nov. 15, 2018, now Pat. No. 11,111,052.

(51) Int. Cl.
*B65D 5/42* (2006.01)
*B65D 5/72* (2006.01)

(58) Field of Classification Search
USPC ..... 229/120.02, 120.03, 120.08, 120.18, 229/125.12, 125.15, 162.1, 162.3
See application file for complete search history.

(56) References Cited

U.S. PATENT DOCUMENTS 2,000,210 A 5/1935 Bayless
2,330,926 A 10/1943 Rous
2,342,081 A 2/1944 Kirkland et al.
2,349,748 A 5/1944 Otto
2,507,430 A 5/1950 Yancey
2,857,881 A 10/1958 Beebe
2,903,175 A 9/1959 Peimer
2,950,851 A 8/1960 Peimer
2,983,421 A 5/1961 Turpin
2,983,424 A 5/1961 Glass
3,009,565 A 11/1961 Leone
3,016,178 A 1/1962 Knocks
3,033,436 A 5/1962 Peimer
3,040,953 A 6/1962 Tindall
3,079,062 A 2/1963 Craddock
3,082,929 A 3/1963 Aquino et al.
3,115,290 A 12/1963 Byassee
3,126,141 A 3/1964 Walter
3,229,888 A 1/1966 Gillam
3,438,482 A 4/1969 Hamilton
3,441,125 A 4/1969 Small
3,539,089 A 11/1970 Osberg
3,610,510 A 10/1971 Lowry
3,669,336 A 6/1972 Robinson
3,819,093 A 6/1974 Forbes
3,907,108 A 9/1975 Weimer
4,054,203 A 10/1977 Farquhar
4,063,679 A 12/1977 Henry
4,081,128 A 3/1978 O'Neill
4,094,456 A 6/1978 Roccaforte
4,141,485 A 2/1979 Lambert
4,197,985 A 4/1980 Austin
4,201,329 A 5/1980 Roccaforte
4,274,578 A 6/1981 Montealegre
4,349,105 A 9/1982 Bradley et al.
4,361,270 A 11/1982 Roccaforte
4,438,848 A 3/1984 Montealegre
4,452,355 A 6/1984 Benham
4,548,318 A 10/1985 Boyle
4,609,142 A 9/1986 Adamek
5,040,721 A 8/1991 Essack
D319,976 S 9/1991 Wortley et al.
D320,935 S 10/1991 Nylander
5,056,708 A * 10/1991 Boyle ..... B65D 5/48014 229/120.18
5,135,158 A 8/1992 Boyle et al.
5,145,070 A 9/1992 Pallett et al.
5,197,625 A 3/1993 Mullaney
5,348,219 A 9/1994 Brintazzol
D361,262 S 8/1995 Lusker
5,465,834 A 11/1995 Sieber et al.
5,505,370 A 4/1996 Brown et al.
5,505,373 A 4/1996 Von Stillfried
5,540,330 A 7/1996 Lo Duca
5,607,058 A * 3/1997 Huesman ..... B65D 5/4204 206/823
D390,330 S 2/1998 Skaya
5,725,620 A 3/1998 Perea et al.
5,845,424 A 12/1998 Mitchell
5,918,799 A 7/1999 Walsh
5,927,498 A 7/1999 Saam
D425,413 S 5/2000 Heeley et al.
6,079,563 A 6/2000 Katchmazenski
6,116,499 A 9/2000 Hengami
6,227,440 B1 5/2001 Hart
6,273,332 B1 8/2001 Hengami
6,360,942 B2 * 3/2002 Todjar Hengami .. B65D 5/0254 229/117.35
D455,455 S 4/2002 Katsuyama
6,393,707 B1 5/2002 Maffei
6,394,275 B1 5/2002 Paliotta et al.
6,435,402 B1 * 8/2002 Hengami ..... B65D 5/0263 229/131.1
6,474,040 B1 11/2002 Ours et al.
6,637,646 B1 10/2003 Muise et al.
6,691,869 B2 2/2004 Knaack et al.
6,733,555 B1 5/2004 Wilder
6,889,892 B2 5/2005 Walsh et al.
D508,850 S 8/2005 Ghini et al.
6,945,449 B2 9/2005 Hengami
6,971,524 B1 12/2005 Voswinkel
7,040,528 B2 5/2006 Hengami
7,097,043 B2 8/2006 Hsu
7,156,286 B2 1/2007 Hengami
D551,967 S 10/2007 Hengami
D552,987 S 10/2007 Magnusson
7,337,904 B2 3/2008 Hengami
D580,754 S 11/2008 An
7,494,044 B2 2/2009 Walsh et al.
7,503,475 B2 3/2009 McGowan
D594,743 S 6/2009 Lukka
7,661,578 B2 2/2010 Li
7,743,973 B2 6/2010 Hengami
7,992,764 B2 8/2011 Magnusson
8,261,964 B2 9/2012 Raupach et al.
8,499,999 B2 8/2013 Sieber et al.
8,739,969 B2 6/2014 Schuld
8,800,855 B2 8/2014 Fitzwater
8,844,797 B2 9/2014 Smith
9,085,386 B2 7/2015 Hengami
9,394,066 B2 7/2016 Hengami
9,394,076 B2 7/2016 Hengami
9,561,878 B2 2/2017 Lee et al.
9,643,749 B2 5/2017 Wagner
10,086,990 B2 10/2018 Hengami
10,899,496 B2 1/2021 Hengami
11,066,209 B2 7/2021 Hengami
11,111,052 B2 9/2021 Hengami
11,180,281 B2 11/2021 Hengami
11,186,405 B2 11/2021 Hengami
11,220,369 B2 1/2022 Hengami
11,292,634 B2 4/2022 Hengami
11,661,232 B2 5/2023 Hengami
11,667,431 B1 6/2023 Hengami
11,691,779 B2 7/2023 Hengami
11,691,783 B1 7/2023 Hengami
2003/0217944 A1 11/2003 Belloli et al.
2003/0230498 A1 12/2003 Maute
2004/0065723 A1 4/2004 Hengami
2005/0061864 A1 3/2005 Lee
2005/0067476 A1 3/2005 Hengami
2005/0098616 A1 * 5/2005 Chang ..... B65D 5/4204 229/162.6
2005/0211754 A1 9/2005 Fulcher
2006/0124709 A1 6/2006 Hengami
2007/0251848 A1 * 11/2007 Hengami ..... B65D 85/60 229/116.2
2007/0261990 A1 11/2007 Weston et al.
2008/0128478 A1 6/2008 Quadrelli
2008/0128480 A1 6/2008 Hengami
2011/0057024 A1 3/2011 Sieber et al.
2011/0062175 A1 3/2011 Nakamura et al.
2011/0111938 A1 5/2011 Smith
2011/0162997 A1 7/2011 Robbins et al.
2011/0168767 A1 * 7/2011 Hengami ..... B65D 5/0227 229/131.1
2013/0075462 A1 3/2013 Jones et al.
2015/0321788 A1 11/2015 Hengami

(56) References Cited

U.S. PATENT DOCUMENTS

| | | | |
|---|---|---|---|
| 2016/0297589 | A1 | 10/2016 | You et al. |
| 2019/0144156 | A1 | 5/2019 | Hengami |
| 2021/0122519 | A1 | 4/2021 | Hengami |

FOREIGN PATENT DOCUMENTS

| | | | | |
|---|---|---|---|---|
| EP | 0642977 | | 3/1995 | |
| EP | 0732269 | | 9/1996 | |
| EP | 0761550 | | 3/1997 | |
| FR | 2799743 | | 4/2001 | |
| JP | 07223634 | | 8/1995 | |
| JP | 07223634 A | * | 8/1995 | ..... B65D 5/723 |

OTHER PUBLICATIONS

PCT/US2022/34764. International Search Report and Written Opinion dated Oct. 19, 2022.

https://issuu.com/designpackaging/docs/packaging-dielines-free-book-design Packaging & Dielines: The Designer's Book of Packaging Dieline; published at least as early as Sep. 18, 2019; 2 pages.

http://samanthaleewalker.blogspot.in/2012/12/ornament-box-tutorial.html Samantha Walker's Imaginary World: Ornamental Box Tutorial; retrieved Aug. 2, 2018; 1 page.

https://www.pinterest.se/pin/15692298672213867/?lp=true Corrugated Box with internal insert #packaging; retrieved Aug. 2, 2018; 1 page.

* cited by examiner

DUAL CELL, EFFICIENT BOX WITH TOP SLIDE OPENINGS AND VIEW WINDOWS

CROSS-REFERENCE TO RELATED APPLICATIONS

This United States Non-Provisional patent application is a continuation of U.S. Non-Provisional application Ser. No. 17/411,397, titled "Dual Cell, Efficient Box with Top Slide Openings and View Windows," filed Aug. 25, 2021, which is a continuation of U.S. Non-Provisional application Ser. No. 16/192,740, titled "Dual Cell, Efficient Box with Top Slide Openings and View Windows," filed Nov. 15, 2018, the contents of which are incorporated by reference in their entirety herein.

BACKGROUND

Major food and candy manufacturers have high-speed form, fill and seal packaging machines for producing hundreds of boxes of product per minute. These machines take either partially-constructed boxes or box blanks, fold and seal one end, then fill the boxes, and finally fold and seal the opposite end thereby completing the manufacturing. Such machines are frequently used for packaging a solid pourable product, mints or similar small candies being one example. To facilitate dispensing such a solid pourable product, rapid form, fill and seal boxes often incorporate re-closable openings.

One type of closable box known in the art is formed from a cardboard box blank that may be rapid folded, and which offers a re-closable, sliding opening incorporated into the unassembled blank, and which is constructed during the folding process prior to sealing. Known types of closable boxes with slides include those having slides that move up and down at the top of the box and include a catch mechanism to prevent the slide from dislodging. Up to now, such boxes have been limited in that they include a convenient slide opening, but only have one opening and thus can contain only one product.

Therefore there remains a need for a box having two compartments and offering a convenient dual slide opening for easily dispensing a solid pourable or similar product, that is easy to manufacture on a mass production scale using conventional high-speed packaging machines, and that is constructed in such a way to avoid any slide insertion step, but that incorporates multiple independently operable slide openings. There is further a need for such a box having these characteristics while also having the same appearance and handling characteristics as a conventional box, wherein the top flaps are individually lifted to individually dispense the contents according to preference, and which is made from a single sheet of blank stock. There is also a need for a box having two compartments that each include one or more windows through which a viewer can see solid pourable product contained in the two compartments, for alternatively identifying the products therein and additionally determining that the box is either full or empty.

SUMMARY

A package for storing and dispensing solid pourable product includes a number of longitudinally connected panels foldably connected together and to a number of flaps. Preferably there is are front, opposing rear and side panels, and top flaps including slides and bottom flaps, all constructed out of a single cardboard blank. The longitudinally connected panels are folded together to form first and second compartments, each having an aperture through which to dispense the product.

Preferably the slides are at the top end of the package and extend from the rear panel, and the top edges of the slides are movable between an upright semi-open position permitting product to dispense through the apertures and a downward closed position blocking the apertures. Preferably each of the slides is further moveable to a fully open position, so the top end is unobstructed when filling the dual compartment box with the product. Preferably debossed fold lines are used at the foldable connections of the slides to the rear panel. And preferably, the bottom flap is also movable to a fully open position for filling the package with the solid pourable product from the top end.

Preferably the front panel is where the apertures are located, along with windows and display openings to view the contents of each compartment of the package. Preferably the slides further comprise a thumb catch to facilitate their movement by the user of the package.

Optionally, a first slide has a top edge forming a first compartment first catch and a first compartment second catch, and the second slide has a top edge forming a second compartment first catch and a second compartment second catch, and when the blank is folded, an outer tab top flap and a minor side top flap overlap each other and projecting portions of both the outer tab top flap and the minor side top flap form a center stop member that interacts with the slides to prevent the slides from becoming disengaged with the package.

DESCRIPTION

Figure 1:
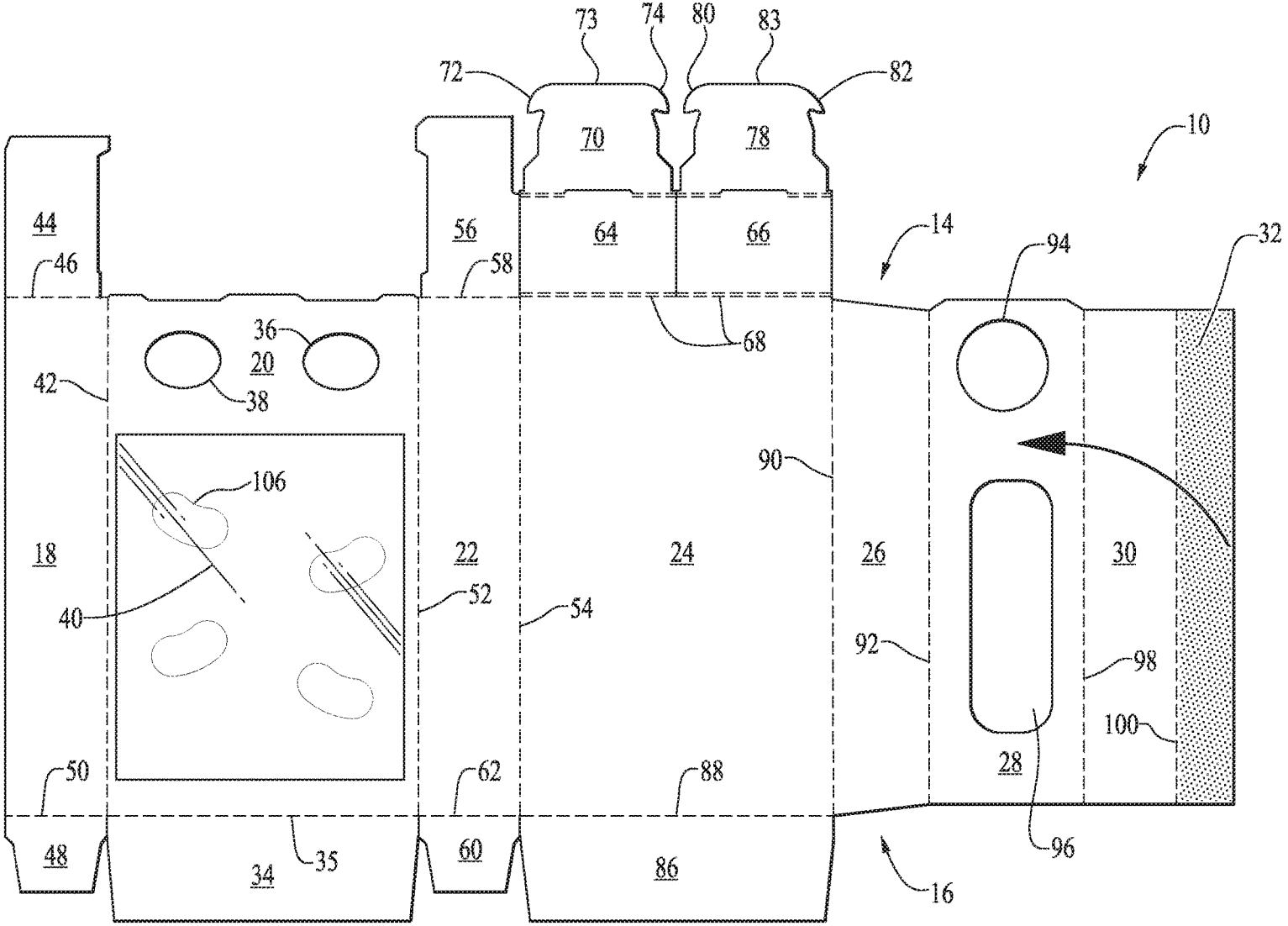
FIG. 1 is a flat pattern view of a cardboard blank from which the dual compartment box with slide openings and view windows is made.
Figure 5:
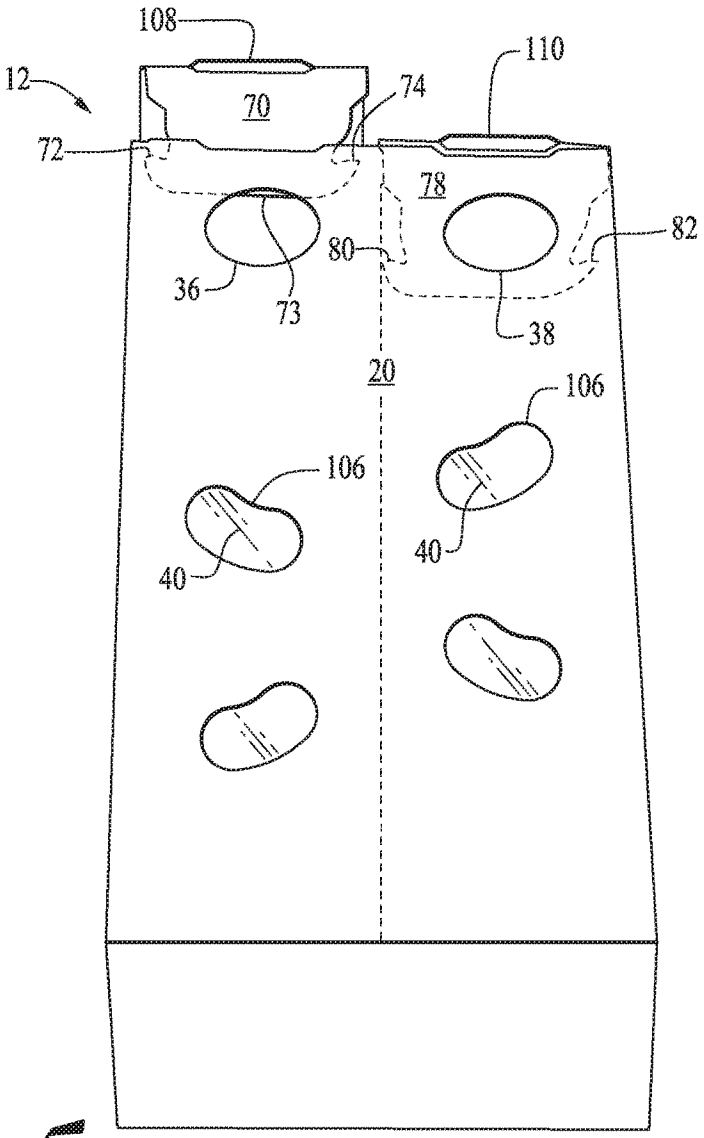
FIG. 5 is a perspective view of an assembled box, including windows for viewing a product in each of the dual compartments and a lifting flap in an open position above one compartment.
Figure 4:
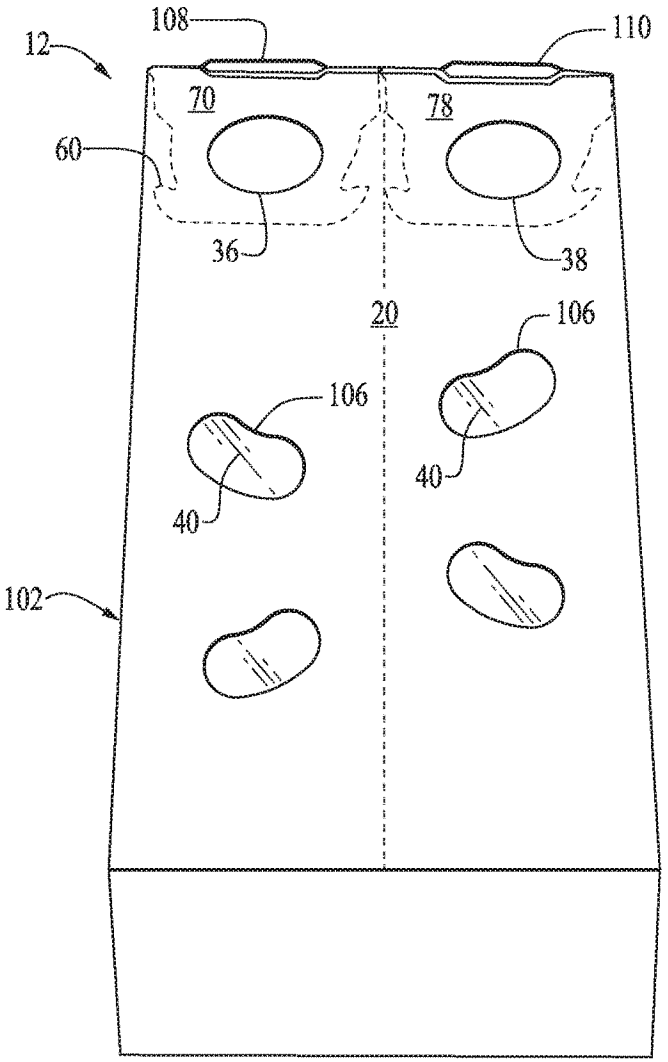
FIG. 4 is a perspective view of a fully assembled box, including windows for viewing a product in each of the dual compartments.

FIG. 1 illustrates a flat pattern die cut paper or cardboard blank 10 that may be folded to form a double compartment box 12 (FIGS. 4 and 5). The blank 10 includes a top end 14 and a bottom end 16 and is scored or otherwise prepared for folding in a predetermined pattern. Major portions of the blank 10 include outer tab 18, front panel 20, first minor side 22, rear panel 24, second minor side 26, compartment panel 28, compartment minor side 30, and inner tab 32, all longitudinally arranged in series and connected together in a folding relationship, which allows for continuous folding to create additional compartments.

Still referring to FIG. 1, the outer tab 18 includes an outer tab top flap 44 foldably connected to outer tab 18 along outer tab top fold line 46, and outer tab bottom flap 48 foldably connected to outer tab 18 along outer tab bottom fold line 50. Outer tab 18 is foldably connected to front panel 20 along outer tab fold line 42.

Front panel 20 is connected to first minor side 22 along first minor side fold line 52. Front panel 20 lacks a top flap, but includes front panel bottom flap 34 connected to front panel 20 along front panel bottom flap fold line 35. Front panel 20 has a top edge with two spaced apart indents, creating a raised portion in between the two indents. Front panel 20 also includes first compartment aperture 36, second compartment aperture 38, and dual compartment window 40 by which users of the box 12 may view a solid pourable product (not shown) or similar solid foods or snacks contained therein through solid pourable product windows 106. Dual compartment window 40 comprises a single sheet of plastic material that extends over solid pourable product windows 106 in both the first compartment and the second compartment. First minor side 22 includes first minor side top flap 56 foldably connected to first minor side 22 along first minor side top fold line 58, and first minor side bottom flap 60 foldably connected to first minor side 22 along first minor side bottom fold line 62. Outer tab top flap 44 and first minor side top flap 56 preferably overlap and are shaped to provide adequate insertion space for first compartment slide 70 and second compartment slide 78.

Rear panel 24 is connected to first minor side 22 along first minor side fold line 52, and is connected to second minor side 26 along third minor fold line 90. Rear panel 24 includes first compartment top flap 64 and second compartment top flap 66 both foldably connected along dual compartment fold lines 68, 76, 84. Dual compartment fold lines 68, 76, 84 are preferably debossed, and allows for the indentation of first catch 108 and second catch 110 (FIGS. 4 and 5) against front wall 20 for full contact. First compartment slide 70 is connected to first compartment top flap 64 along first compartment fold line(s) 76 and includes at the top edge 73 first compartment first catch 72 and first compartment second catch 74. Second compartment slide 78 is connected to second compartment top flap 66 along second compartment fold line(s) 84 and similarly at the top edge 83 includes second compartment first catch 80 and second compartment second catch 82. First compartment first catch 72, first compartment second catch 74, second compartment first catch 80 and second compartment second catch 82 are formed with sharp radii for high speed insertion. Opposing first compartment top flap 64 and second compartment top flap 66 on rear panel 24 is rear panel bottom flap 86 connected to rear panel 24 along rear panel bottom fold line 88.

The second minor side 26 lacks any top or bottom flaps, and is connected to second compartment front panel 28 along fourth minor fold line 92. Second compartment front panel 28 includes third aperture 94 proximate top end 14, and below third aperture 94, second compartment display window 96 extends across a majority of second compartment front panel 28. Compartment minor side 30 is foldably connected to second compartment front panel 28 along compartment minor side fold line 98, and connected to inner tab 32 along inner tab fold line 100. Like second minor side 26 and second compartment front panel 28, compartment minor side 30 lacks any top or bottom flaps. Compartment minor side is foldably connected to inner tab 32 along inner tab fold line 100, and similar to third minor side 30, inner tab 32 lacks any top or bottom flaps.

As indicated by the arrow in FIG. 1, a first step may be folding the compartment front panel 28, compartment minor side 30 and inner tab 32 up and over rear panel 24. In the process, inner tab 32 may be turned at a right angle, negative or positive 90 degrees, relative to the adjoining third minor side 30, for affixing to rear panel 24. In one preferred embodiment, positive 90 degree folds occur at fifth minor fold line 98, fourth minor fold line 92, and third minor fold line 90 until second compartment 104 is formed.

Figure 2:
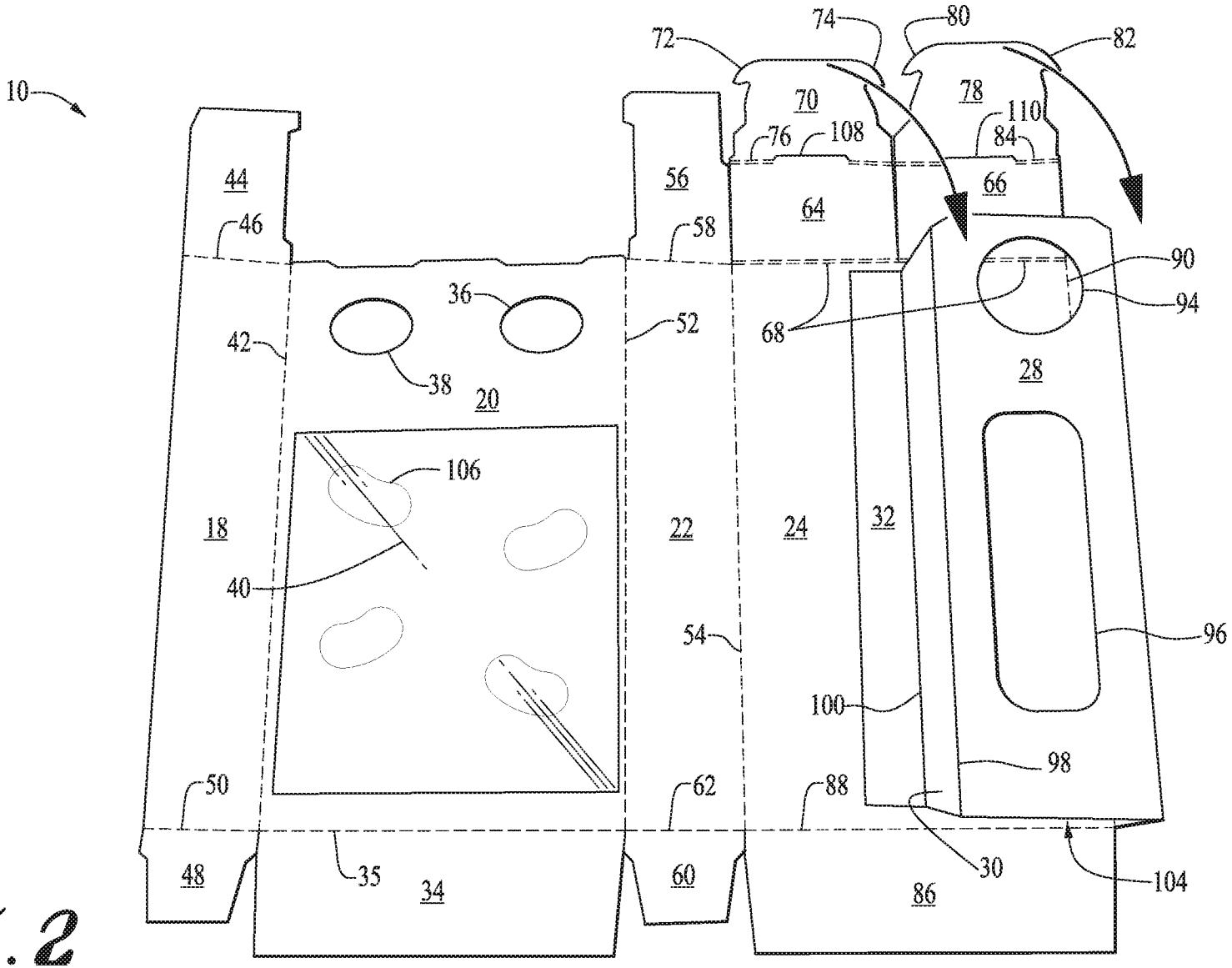
FIG. 2 is a perspective view of the cardboard blank showing an initial stage of assembly and a first compartment.

Referring to FIG. 2, the cardboard blank 10 is shown following the first assembly step and creation of second compartment 104. Inner tab 32, third minor side 30, second compartment front panel 28, and second minor side 26 have been folded over rear panel 24, with second minor side 26 disposed substantially at a right angle to the adjoining second compartment front panel 28 and rear panel 24. Preferably, inner tab 32 has been folded along inner tab fold line 100 and affixed to rear panel 24 in alignment between first compartment top flap 64 and second compartment top flap 66, such that second compartment top flap 66 substantially covers second compartment 104.

Subsequent stages of assembly include folding first compartment top flap 64 and second compartment top flap 66 along dual compartment fold line 68 such that both first compartment top flap 64 and second compartment top flap 66 are each disposed at a substantially right angle to the adjoining rear panel 24. First compartment slide 70 is then folded at first compartment fold line 76, creating a right angle between the two components and thus covering third aperture 94 on second compartment front panel 28. Second compartment lifting flap 78 is folded at second compartment fold line 84, creating a right angle between the two components similar to second compartment top flap 66 and second compartment lifting flap 78.

Figure 3:
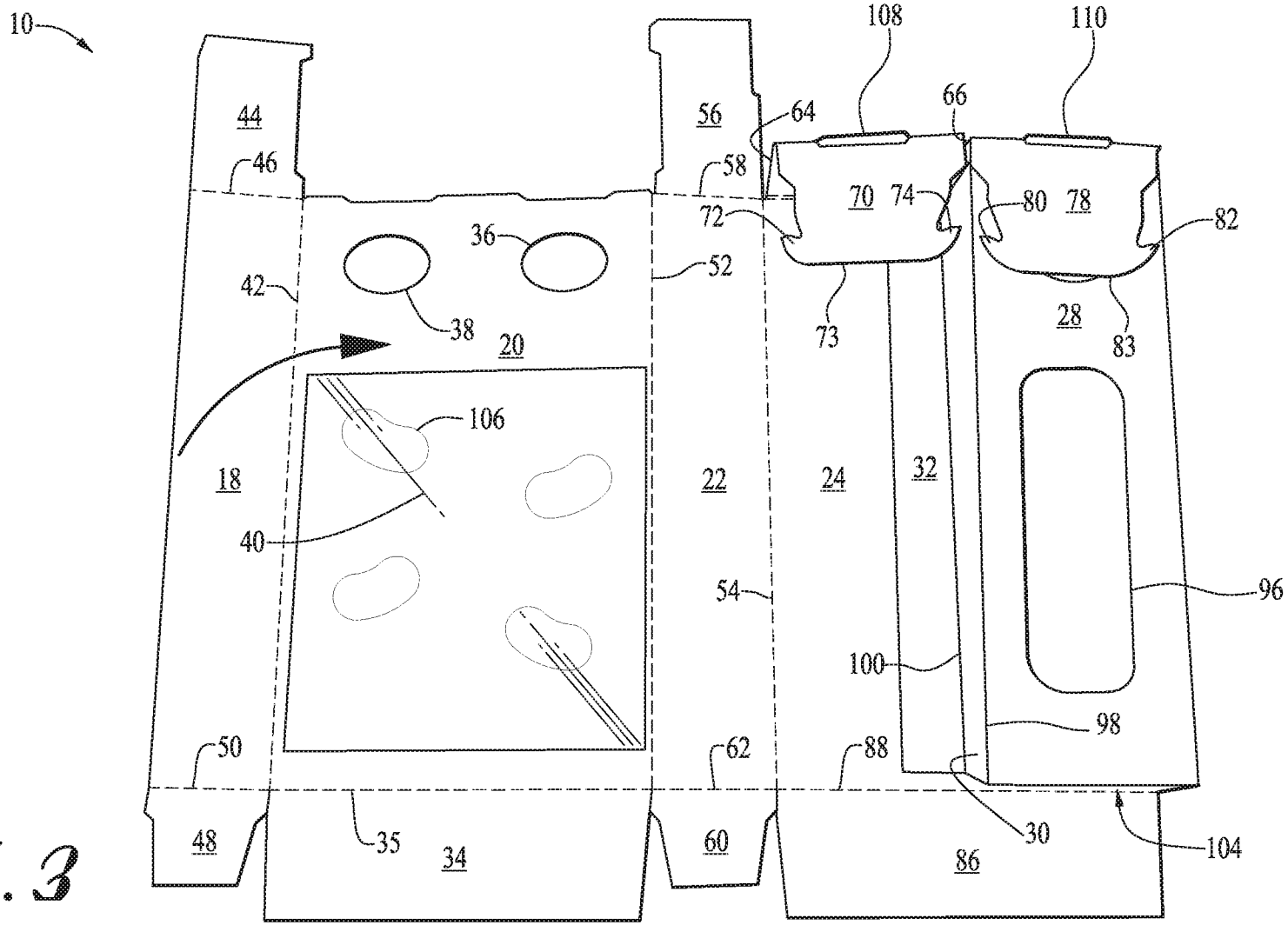
FIG. 3 is a perspective view of the cardboard blank showing a subsequent stage of assembly, positioning of lifting flaps and assembly of a second compartment.

Referring to FIG. 3, the cardboard blank 10 is shown after the assembly step forming second compartment 104, as first compartment top flap 64, second compartment top flap 66, first compartment slide 70 and second compartment slide 78 have been folded. To continue assembling the box 12, outer tab 18 and front panel 28 are folded over such that front panel 20 is placed atop second compartment front panel 28, and outer tab 18 is placed over second minor side 26. Outer tab 18 is preferably secured to second minor side 26 by adhesive. To achieve such a configuration, the cardboard blank 10 is folded at outer tab fold line 42, first minor fold line 52, and second minor fold line 54. In folding the front panel 28 over the second compartment front panel 28, a first compartment 102 is created parallel and adjacent the second compartment 104.

In a preferred embodiment, outer tab top flap 44 is folded substantially at a right angle along outer tab top flap fold line prior to folding first compartment lid 64 and second compartment lid 66. Similarly, first minor side top flap 56 is folded substantially at a right angle along first minor side top fold line 58 prior to folding first compartment lid 64 and second compartment lid 66. Thus, outer tab top flap 44 and first minor side top flap 56 will reside under first compartment top flap 64 and second compartment top flap 66. Also shown in this view are first catch 108 and second catch 110, which serve to catch a user's thumb or other digit when lifting the first compartment slide 70 or second compartment slide 78.

FIG. 4 shows the box 12 in a fully assembled state. First compartment slide 70 rests behind first compartment aperture 36 and the second compartment slide 78 rests behind the second compartment aperture 38. Second compartment aperture 38 is placed atop third aperture 94 (FIGS. 1-3) such that a portion of third aperture 94 is covered by a portion of front panel 20. To achieve this configuration, first compartment top flap 64 is placed atop outer tab top flap 44 and the second compartment top flap 66 is placed atop first minor side top flap 56. The bottom portion of the box 12 is formed by folding front panel bottom flap 34, rear panel bottom flap 86, outer tab bottom flap 48, and first minor side bottom flap 60 inward. In a preferred embodiment, product may be filled in the package 12 prior to formation of the bottom end 16 of the box 12. In another embodiment, product may be filled in the box 12 prior to formation of the top end 14 of the box 12. The solid pourable product window 106 and dual compartment window have been located atop second compartment display window 96 so that solid pourable product can be seen through them.

FIG. 5 shows the box 12 in full assembly with the first compartment lifting flap 70 in an upright position, so that first compartment aperture 36 is exposed, creating access to first compartment 102. When the top flaps 44 and 56 and folded, they overlap each other and the projecting portions of the top flaps 44 and 56 create a center stop that interacts first compartment second catch 74 and second compartment first catch 80. Interaction between first compartment first catch 72 and first compartment second catch 74 with first minor side top flap 56 prevents first compartment lifting flap 70 from becoming disengaged with the box 12.

While particular forms of the invention have been illustrated and described, it will also be apparent to those skilled in the art that various modifications can be made without departing from the spirit and scope of the invention. Accordingly, it is not intended that the invention be limited except by the appended claims.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A package for storing and dispensing solid pourable product, the package comprising:

a blank having an outer tab coupled to a front panel;

a first minor side panel coupled to the front panel and a rear panel;

a second minor side panel coupled to the rear panel and a second compartment front panel;

a compartment minor side panel coupled to the second compartment front panel and an inner tab;

wherein the rear panel has a first compartment top flap and a second compartment top flap foldably coupled thereto;

the panels forming a first compartment and a second compartment within the package;

a first slide and a second slide extending from the first compartment top flap and the second compartment top flap, respectively, and being movable between an upright semi-open position permitting at least some product to dispense through at least one aperture and a downward closed position blocking the at least one aperture;

wherein the first slide has a top edge forming a first compartment first catch and a first compartment second catch, and the second slide has a top edge forming a second compartment first catch and a second compartment second catch;

an outer tab top flap having a distal projecting portion;

a minor side top flap having a distal projecting portion;

wherein, when the blank is folded, the outer tab top flap and the minor side top flap overlap each other and the projecting portions of both the outer tab top flap and the minor side top flap form a center stop member that interacts with the first compartment second catch and the second compartment first catch to prevent the slides from becoming disengaged with the package.

2. The package of claim 1 wherein the first slide and the second slide are foldably coupled to the rear panel and debossed.

3. The package of claim 1 wherein the first slide and the second slide are each movable to a fully open position for filling the package.

4. The package of claim 1 wherein there is at least one window in the front panel.

5. The package of claim 4, further comprising a dual compartment window that comprises a single sheet of material extending over at least one window for viewing the product inside the package in both the first and second compartments.

6. The package of claim 5 wherein the blank further comprises a compartment panel having a display opening aligned with the window.

7. The package of claim 1 wherein the at least one aperture is in the front panel.

8. The package of claim 1 wherein the first slide covers a portion of the first compartment when the first slide is in the downward closed position, and the second slide covers a portion of the second compartment when the second slide is in the downward closed position.

9. The package of claim 1 wherein the first slide and the second slide each further comprise a thumb catch to facilitate movement of the first slide and the second slide to their respective upright semi-open positions.

10. The package of claim 1, wherein the outer tab, front panel, first minor side panel, rear panel, second minor side panel, second compartment front panel, minor side panel, and inner tab all extend longitudinally.

11. The package of claim 1, wherein the front panel has a top edge with two spaced apart indents, creating a raised portion in between the two indents.

12. A dual compartment box to retain and conveniently dispense solid pourable product comprising:

a blank having an outer tab coupled to a front panel;

a first minor side panel coupled to the front panel and a rear panel, wherein the rear panel is also foldably connected to a second minor side panel coupled to the rear panel and a second compartment front panel;

a compartment minor side panel coupled to the second compartment front panel and an inner tab;

the rear panel having a first compartment top flap and a second compartment top flap foldably coupled thereto;

wherein the panels form a first compartment and a second compartment within the package, each compartment including at least one aperture to dispense product therefrom;

a first slide and a second slide extending from the first compartment top flap and the second compartment top flap, respectively, and being movable between an upright semi-open position and a downward closed position;

wherein the first slide has a top edge forming a first compartment first catch and a first compartment second catch, and the second slide has a top edge forming a second compartment first catch and a second compartment second catch;

an outer tab top flap having a distal projecting portion;

a minor side top flap having a distal projecting portion;

wherein, when the blank is folded, the outer tab top flap and the minor side top flap overlap each other and the projecting portions of both the outer tab top flap and the minor side top flap form a center stop member that interacts with the first compartment second catch and the second compartment first catch to prevent the slides from becoming disengaged with the package; and the dual compartment box being entirely foldably constructed from a single piece blank.

13. The dual compartment box of claim 12, further comprising a bottom flap that is moveable to an open position for filling the dual compartment box with the solid pourable product from the bottom end.

14. The dual compartment box of claim 12, wherein the top flaps are foldably coupled to the rear panel by an embossed fold.

15. The dual compartment box of claim 12, wherein the two separate compartments each have a window enabling viewing of the solid pourable product when inside the dual compartment box and the compartment panel has a display opening aligned with the windows.

16. The box of claim 15, further comprising a dual compartment window that comprises a single sheet of material extending over the windows for viewing the product inside the package in both the first and second compartments.

17. The package of claim 12, wherein the first slide and the second slide each further comprise a thumb catch to facilitate movement of the first slide and the second slide to their respective upright semi-open positions.

18. The box of claim 12, wherein the front panel has a top edge with two spaced apart indents, creating a raised portion in between the two indents.

19. The box of claim 12, wherein outer tab, front panel, first minor side panel, rear panel, second minor side panel, second compartment front panel, minor side panel, and inner tab all extend longitudinally.

* * * * *